United States Patent [19]

Hesch

[11] 3,964,961

[45] June 22, 1976

[54] METHOD FOR STORING BAGASSE

[75] Inventor: Rolf Hesch, Nettetal, Germany

[73] Assignee: Becker & van Hullen Niederrheinische Maschinenfabrik, Krefeld, Germany

[22] Filed: Mar. 11, 1975

[21] Appl. No.: 557,321

Related U.S. Application Data

[63] Continuation-in-part of Ser. No. 495,283, Sept. 8, 1974, abandoned, which is a continuation of Ser. No. 336,325, Feb. 27, 1973, abandoned.

[30] Foreign Application Priority Data

Feb. 29, 1972 Germany ..... 2209465

[52] U.S. Cl. ..... 162/96; 162/91; 195/33

[51] Int. Cl.[2] ..... D21C 5/00

[58] Field of Search ..... 162/96; 195/8, 9, 10, 195/33; 21/58

[56] References Cited

UNITED STATES PATENTS

| | | | |
|---|---|---|---|
| 1,574,254 | 2/1926 | Munroe | 162/96 X |
| 1,633,594 | 6/1927 | Lathrop et al. | 162/96 X |
| 1,833,493 | 11/1931 | Munroe et al. | 162/96 X |
| 1,920,129 | 7/1933 | Munroe et al. | 195/8 X |
| 2,193,493 | 3/1940 | Ritter | 195/10 |
| 3,802,957 | 4/1974 | Cusi | 162/96 X |

OTHER PUBLICATIONS

"Storage of Crop Fibers & Preservation of Their Products," Hay et al., Tappi Section, Feb. 27, 1941, Paper Trade Journal, pp. 113–118.

*Primary Examiner*—S. Leon Bashore
*Assistant Examiner*—Arthur L. Corbin
*Attorney, Agent, or Firm*—Herbert E. Kidder

[57] ABSTRACT

A method of storing bagasse by piling the bagasse up into a stack on a base structure protected against ground water and having good run-off of surface water. The stack is built up with a substantially horizontal layer structure, wherein each successive layer is piled on only after the preceding layer has completed the phase of most intensive fermentation. The stack is piled up so that it tapers toward the top and forms a ridge, and the top of the stack is covered with a rain-shedding material at the earliest possible time after the top layer has passed its fermentation peak. The rate of fermentation may be controlled by either: (1) decoring the bagasse before storage; (2) separating the fine material out; (3) slightly pre-drying the bagasse before storage; (4) adding fermentation-controlling or fermentation-inhibiting substances to the bagasse; or (5) providing air ducts in the stack to vent off the moist, damp air.

6 Claims, 1 Drawing Figure

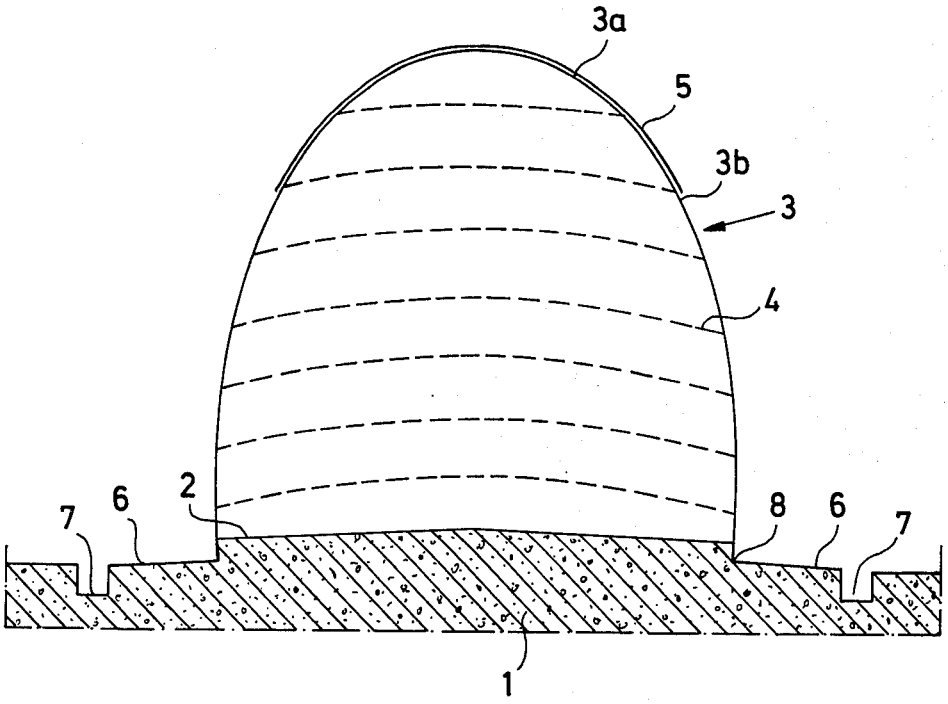
3a
5
3b
3
4
2
6
7
8
6
7
1

METHOD FOR STORING BAGASSE

BACKGROUND OF THE INVENTION

The present invention pertains to a method for storing bagasse and similar lignocellulose-containing raw materials, such as shredded wood fibers, jute fibers, and the like, and is a continuation-in-part of my application Ser. No. 495,283, filed Sept. 8, 1974, now abandoned, which is a continuation of Ser. No. 336,325, filed Feb. 27, 1973, now abandoned which claims priority of German application No. P 22 09 465.1, filed Feb. 29, 1972.

Bagasse as well as various other lignocellulose-containing industrial and agricultural byproducts are gaining increasing importance as industrial raw materials. Among the industries that successfully process these byproducts are, at present, primarily cellulose- and paper factories, chip board and fiber board plants, plants for the production of molded parts for buildings and furniture, and a few others. Most of the time, the abovementioned raw materials are only obtained during a few months of the year, however. In order to be able to operate industrial all year round for economical reasons, corresponding quantities must be stored for the months in which these raw materials are not obtained.

The storage of bagasse and similar raw materials still represents at present the main obstacle for their use on a large scale. Apart from cellulose and lignin, these raw materials also contain hemicellulose, starch and sugar. They still have a relatively high moisture content, in the case of bagasse mostly about 100 percent, related to bone-dry. The low-molecular constituents, particular starch and sugar, represent in the presence of sufficient moisture a good nutrient medium for the growth of bacteria and fungi. As a result, an intensive fermentation reaction sets in very soon in bagasse, for example, by which primarily sugar, but then also other low-molecular constituents, are decomposed to alcohol and finally to acids, primarily aceitic acid. Since fermentation is an exothermic process, considerable amounts of heat are released.

The coincidence of high temperature and acids as a result of the fermentation leads to quality deterioriation of the lignocellulose-containing fibers by hydrolysis. Under extreme conditions complete destruction may even occur. Even after the fermentation has stopped, the decomposition of organic substances continues by bacteria in the higher moisture range and primarily by fungi in the medium moisture range.

SUMMARY OF THE INVENTION

The present invention is concerned with the problem of providing a method for storing bagasse and similar lignocellulose-containing raw materials in a manner whereby the above-mentioned quality-deteriorating phenomena do not occur. The solution is based on the concept, which is likewise an inventive achievement, that contrary to previous concepts, fermentation is not principally a harmful process. According to the findings of the inventor, fermentation is only harmful if it leads, by an excessive temperature buildup and by interaction with organic acids, formed likewise by fermentation, to a considerable hydrolysis of the fiber.

In accordance with the invention, a method was proposed for bulk storage of bagasse and similar lignocellulose-containing raw materials, wherein the bagasse is piled loosely to form a stack on a horizontal surface protected against ground water and having good drainage, and where the fermentation is controlled. The control of fermentation can be effected in a simple manner by building the stack of bagasse with a plurality of successively added-on, horizontal layers, each layer being placed on top of the preceding layer only after the preceding layer has substantially completed its phase of most intensive fermentation. According to the invention, it is advisable to pile the stack so that it tapers toward the top and forms a ridge. This ensures a rapid run-off of rain water.

In an advantageous manner the bagasse is de-cored before storage, that is, the parenchyma is removed. Alternatively, or additionally, the fine material of the bagasse can be separated. Both measures have the advantage that the bagasse piled on the stack is better ventilated, and therefore the heat generated during the fermentation and the moist, warm air can escape easier. This prevents the buildup of excessive temperatures, and thus inhibits the onset of considerable hydrolytic processes. At the same time, the drying of the bagasse fibers is considerably accelerated. Accelerated drying, in turn, worsens the living conditions for bacteria and fungi which can attack lignocellulose-containing raw materials and decompose them. With low quality standards or a particularly well-decomposed bagasse, the measure will be limited as a rule to the separation of the fine material so that de-coring is not necessary.

Another measure, namely the control of fermentation, consists in that the bagasse is pre-dried slightly before storage.

Finally, it is also possible to add to the bagasse fermentation-controlling or fermentation-inhibiting additives.

According to another feature of the invention it is provided that the completely piled-up stack is covered with a rain-repelling material, at the earliest possible time after the fermentation peak of the top layer has passed. If no breathing material is used, it is necessary or at least desirable to provide air ducts between the covering and the top stack boundary, as well as inside the stack, with corresponding outlet ports. For economical reasons it is advisable to provide the covering merely from the ridge of the stack to the part of the stack flank where the angle of inclination is steep enough to ensure a sufficiently high velocity of flow for the impinging rain water to prevent penetration into the deeper layers of the stack.

According to another feature of the invention, a sliding working roof is provided, so that little or no rain water can fall on the stack to be piled up during the buildup of the individual layers and the rainfalls in between.

DESCRIPTION OF THE DRAWING

The drawing shows, in a schematic sectional representation, a bagasse bulk-storage stack, piled up in accordance with the invention.

DESCRIPTION OF THE PREFERRED EMBODIMENT

On a ground water-proof foundation 1 of concrete, for example, which is beveled at the top in the manner of a saddle roof 2, bagasse is piled up in layers to form a stack 3. The individual, substantially horizontal layers are indicated by broken lines 4.

The stack tapers toward the top and forms a ridge 3*a*. which is covered with a tarpaulin 5. The tarpaulin 5 extends fown to a part of the stack flank 3*b* where the angle of inclination is steep enough to ensure a rapid run-off of rain water impinging so that penetration into deeper layers of the stack 3 is not possible.

Laterally, the foundation 1 is provided with stepped end flanks 6, which terminate in rain gutters 7. Due to the steps, a backwater threshold 8 is formed so that no rain water can penetrate into the bagasse stack 3.

The layers of the stack are added, one on top of the other, at intervals of time, allowing each layer to reach and pass its fermentation peak before the next layer is added. Fermentation is an exothermic process, with evolution of a considerable amount of heat, which causes the bagasse to heat up. The temperature of the stack of bagasse is an indicator of the stage of fermentation, and as the temperature reaches its peak and diminishes, it is evident that the peak of fermentation has been passed. Maximum temperature in the center of each layer may reach as high as 130° to 140°F, depending upon the amount of carbohydrate and moisture present, and also, to a lesser extent, upon the ambient temperature. Thus, the peak of fermentation is determined by monitoring the temperature of the stack of bagasse, using a thermometer.

Ventilation can be accomplished by de-coring the bagasse, which is done by removing the parenchyma, or separating our the fine material. Fermentation can be controlled by ventilation; or by predrying the bagasse slightly to about 80 to 90 percent relative humidity, referred to dry matter, before piling it on the stack; or by a combination of the two.

The first step in the process of my invention is to depith the begasse and, if necessary, separate out the fines. If the moisture content of the bagasse exceeds about 80 to 90 percent relative humidity, referred to dry matter, the bagasse is predried somewhat to bring its relative humidity down to the 80–90 percent level. The depithed bagasse of 80–90 percent humidity is then piled up on the foundation 1 to form the first layer, the top of which is indicated by the lowermost broken line 4. A thermometer is inserted into the center of the layer for the purpose of monitoring the temperature as fermentation proceeds. The tarpaulin 5 may be placed over the pile to protect it from rain, and is propped up to provide an open breathing space for the top surface of the pile so as to prevent a hot and humid micro-climate growth under the tarpaulin that favors microbiologic life.

Over a period of several days, fermentation proceeds until it reaches a peak, which is marked by a maximum temperature of about 130°–140° F, followed by a drop in temperature. When the temperature has dropped 5°–10°F, it is clear-cut evidence that the fermentation peak has been reached, and the next layer can be built. Each layer is thus built up in succession, allowing fermentation of each layer to proceed just beyond its peak before adding the next layer. As in the case described, the peak of fermentation for each layer is determined when the termperature at the center of the layer reaches a maximum reading on the thermometer and then starts to drop. As each layer ferments, the temperature is kept from rising too fast or too high by adjusting ventilation of the stack. When the stack is finally completed, as shown in the drawing, the tarpaulin 5 is placed over its top surface, and the stack will now keep for many months with little or no deterioriation in the quality of the bagasse fiber.

In the present invention, depithing before storage is one of the most important means for controlling fermentation in such a way that full beneficial use is made of fermentation without any of the decomposition of lignin and hemicellulose, or hydrolysis of cellulose, or self-ignition of the bagasse which may result from uncontrolled fermentation. Fermentation is kept under control by treating each of the separate layers, which allows the fermentation to proceed in small batches that are manageable. Heat generated within the relatively thin layers is thus allowed to escape fast enough to prevent an excessive heat build-up. At the same time, temperature is relatively uniform throughout each layer during the fermentation cycle.

Depithing normally has been done after the bagasse leaves the sugar mill. However, in recent years, systems have been developed to disintegrate the sugar cane to such an extent that the bagasse leaves the sugar mill already depithed. In such case, screening-off or air-separating the loose pith shall be understood to be the equivalent of depithing for purposes of the present invention.

An alternative method of ventilating the stack is to place air ducts between the covering 5 and the top boundary of the stack, as well as inside the stack, with corresponding outlet ports. For example, short lengths of pipe could be placed horizontally in the stack between layers, with one end of the pipe inside the stack, and the other end on the outside.

Having now described my invention, what I claim is:

1. The method for storing bagasse in bulk to be used in the manufacture of articles having relatively high strength, in which the degradation of lignocellulose-containing fibers by hydrolysis and the decomposition of organic substances by bacteria and fungi is inhibited or prevented, comprising the steps of:

a. treating the bagasse before storing it to inhibit its fermentation rate;

b. piling the treated bagasse loosely in a first horizontal layer on a surface protected against ground water;

c. allowing fermentation to proceed at a controlled rate within said first horizontal layer, while allowing the heat and moisture within the pile to escape at a rate such that the temperature of the pile is prevented from building up excessively, until fermentation has passed its peak, as evidenced by a drop in the temperature of the pile;

d. piling successive layers of treated bagasse loosely on top of said first layer to form a substantially layered structure in which the material in all layers is well-aerated, each layer being piled on only after the preceding layer has passed the peak of fermentation; and then e. covering the top layer with a rain-repellent cover at the earliest possible time after the top layer has passed its fermentation peak.

2. The method of claim 1, wherein the step of treating the bagasse before storage to inhibit its fermentation rate comprises de-coring the bagasse to remove the parenchyma therefrom.

3. The method of claim 1, wherein the step of treating the bagasse before storage to inhibit its fermentation rate comprises separating out the fine material of the bagasse.

4. The method of claim 1, wherein the step of treating the bagasse before storage to inhibit its fermentation rate comprises pre-drying the bagasse to about 80 to 90 percent relative humidity.

5. The method of claim 1, wherein said rain-repellent cover is a porous breathing material.

6. The method of claim 5, wherein air ducts are provided between the cover and the top surface of the pile, so as to allow warm moist air to escape readily from beneath the cover.

* * * * *